US005499692A

United States Patent [19]

Brook

[11] Patent Number: 5,499,692

[45] Date of Patent: Mar. 19, 1996

[54] ESCAPE LADDER

[76] Inventor: Simon Brook, 16A Pavillion Terrace, Wood Lane, London, W12 OHT, United Kingdom

[21] Appl. No.: 284,483

[22] PCT Filed: Feb. 8, 1993

[86] PCT No.: PCT/GB93/00260

§ 371 Date: Sep. 6, 1994

§ 102(e) Date: Sep. 6, 1994

[87] PCT Pub. No.: WO93/16266

PCT Pub. Date: Aug. 19, 1993

[30] Foreign Application Priority Data

Feb. 6, 1992 [GB] United Kingdom ..... 9202506

[51] Int. Cl.[6] ..... E06C 9/14

[52] U.S. Cl. ..... 182/196; 182/206

[58] Field of Search ..... 182/196–199, 182/206, 70–76

[56] References Cited

U.S. PATENT DOCUMENTS

| | | | |
|---|---|---|---|
| 1,340,627 | 5/1920 | Powell . | |
| 2,615,665 | 10/1952 | Baxter | 248/208 |
| 3,307,654 | 3/1967 | Green et al. | 182/198 |
| 3,727,724 | 4/1973 | Gilbert et al. | 182/198 |
| 3,907,064 | 9/1975 | Svalberg | 182/70 |
| 3,907,067 | 9/1975 | Kennedy | 182/164 |
| 4,143,741 | 3/1979 | Souza | 182/198 |
| 4,664,224 | 5/1987 | Chen | 182/73 |

FOREIGN PATENT DOCUMENTS

| | | |
|---|---|---|
| 43020 | 4/1888 | Germany . |
| 2504665 | 8/1976 | Germany . |
| 416460 | 10/1934 | United Kingdom . |
| 2123470 | 2/1984 | United Kingdom . |
| 2235717 | 3/1991 | United Kingdom . |
| WO9015915 | 12/1990 | WIPO . |

*Primary Examiner*—Alvin C. Chin-Shue
*Attorney, Agent, or Firm*—Edwin D. Schindler

[57] ABSTRACT

An escape ladder of collapsible construction has links interconnecting rungs with one end of the ladder being provided with means for fixing the ladder to a structure. At least one end of each link is arrange for movement relative to its respective in a direction axially of the rung between as first position in which the link is able to pivot relative to the rung, and in a second position in which pivotal movement is prevented.

9 Claims, 5 Drawing Sheets

ESCAPE LADDER

This invention relates to escape ladders used, for instance, in escaping from an upper story of a building in the event of an emergency.

In recent years the public have become increasingly security conscious with many devices being proposed to facilitate the safe and swift escape from buildings in an emergency such as a fire. Such devices include emergency chutes and ladders.

Many known escape ladders are provided in a rolled or folded condition such that they can be stored in close proximity to an emergency exit such as a window. Some of these known ladders nave been provided with means at one end for engaging a window sill or ledge for securing the ladder inside the window. Such a fixing does not necessarily work with every window sill or ledge structure and, if there is not window sill or ledge, the ladder cannot be used. With escape ladders which are provided in rolled or folded condition, there is a possibility that the ladder will not unfold or unroll correctly. Particularly in the case where the links between the rungs are in the form of chains or other flexible elements, these elements may become twisted or tangled during the unfolding procedure and the ladder will not extend to its full length. In addition ladders in which the links are in the form of flexible elements are often difficult to climb down because of the swinging movement induced in the ladder.

The present invention is concerned with an escape ladder which, in one or more of its aspects, overcomes or at least partially overcomes some of the disadvantages of known escape ladders.

According to a first aspect of the present invention there is provided an escape ladder of collapsible construction having rungs spaced by side links, each side link connecting two adjacent rungs, one end of the ladder being provided with means for fixing the ladder to a structure, at least one end of each link being arranged for movement relative to its respective rung in a direction axially of the rung between a first position which the link is able to pivot relative to the rung and a second position in which relative pivotal movement is prevented.

Preferably the escape ladder of the invention includes means to lock said one of the links relative to the rung to prevent movement axially of the rung.

Preferably, each rung has connected to it two pairs of links, a first pair being rigidly attached to said rung and extending to an adjacent rung to which they are attached for movement axially thereto, each of said second pair extending, in its second position, in a direction which is substantially aligned with, or with its axis parallel to, the axes of the links of the first pair.

Preferably, there is provided means for biasing said one end of each link into its second position. More preferably the link end is spring loaded.

According to a second aspect of the present invention there is provided an escape ladder of collapsible construction having rungs spaced by side links, each side link connected to adjacent rungs, one end of the ladder being provided with means for fixing the ladder to the structure, said fixing means being provided with structure engaging elements arranged to engage the structure on substantially opposite sides thereof, the fixing means including means for varying the distance between said structure engaging elements according to the distance between said substantially opposite sides.

Preferably the fixing means are in the form of an adjustable claw bracket.

Preferably an escape ladder in accordance with either aspect of the present invention is provided with a sheet of fireproof material which, when the ladder is in its collapsed condition, is sandwiched between the rungs and links and, when the ladder is in its extended condition, extends between the ladder and the structure to which the ladder is fixed.

Preferably a ladder in accordance with either aspect of the present invention is provided with spacing means which, when the ladder is in use in its extended condition space the rungs from the structure to which the ladder is fixed. More preferably the spacing means are generally U-shaped, the ends of which are located in apertures in the ladder rung.

Preferably an escape ladder in accordance with either aspect of the present invention is such that the fixing means provides an outer frame within which the ladder may be stored in its collapsed condition. More preferably the ladder is held within this frame by means of at least one flexible, elongate element attached to said frame and at least partially releasable therefrom by operation of a simple release means to allow the ladder to be extended. The release means could Embodiments of the present invention will now he described by way of examples and with reference to the accompanying drawings, in which:

FIG. 1 shows the first embodiment of an escape ladder in accordance with the present invention in its collapsed condition;

FIG. 1*a* shows a second embodiment of an escape ladder of the present invention, also in its collapsed condition;

FIG. 1*b* shows the escape ladder of FIG. 1A in its extended condition and fixed to a structure;

Referring to FIGS. 1, 2, 3 and 4 of the accompanying drawings, an escape ladder 1 in accordance with the present invention includes an adjustable claw bracket 3 which provides a frame within which the ladder 5 is folded when not in use.

Figure 1:
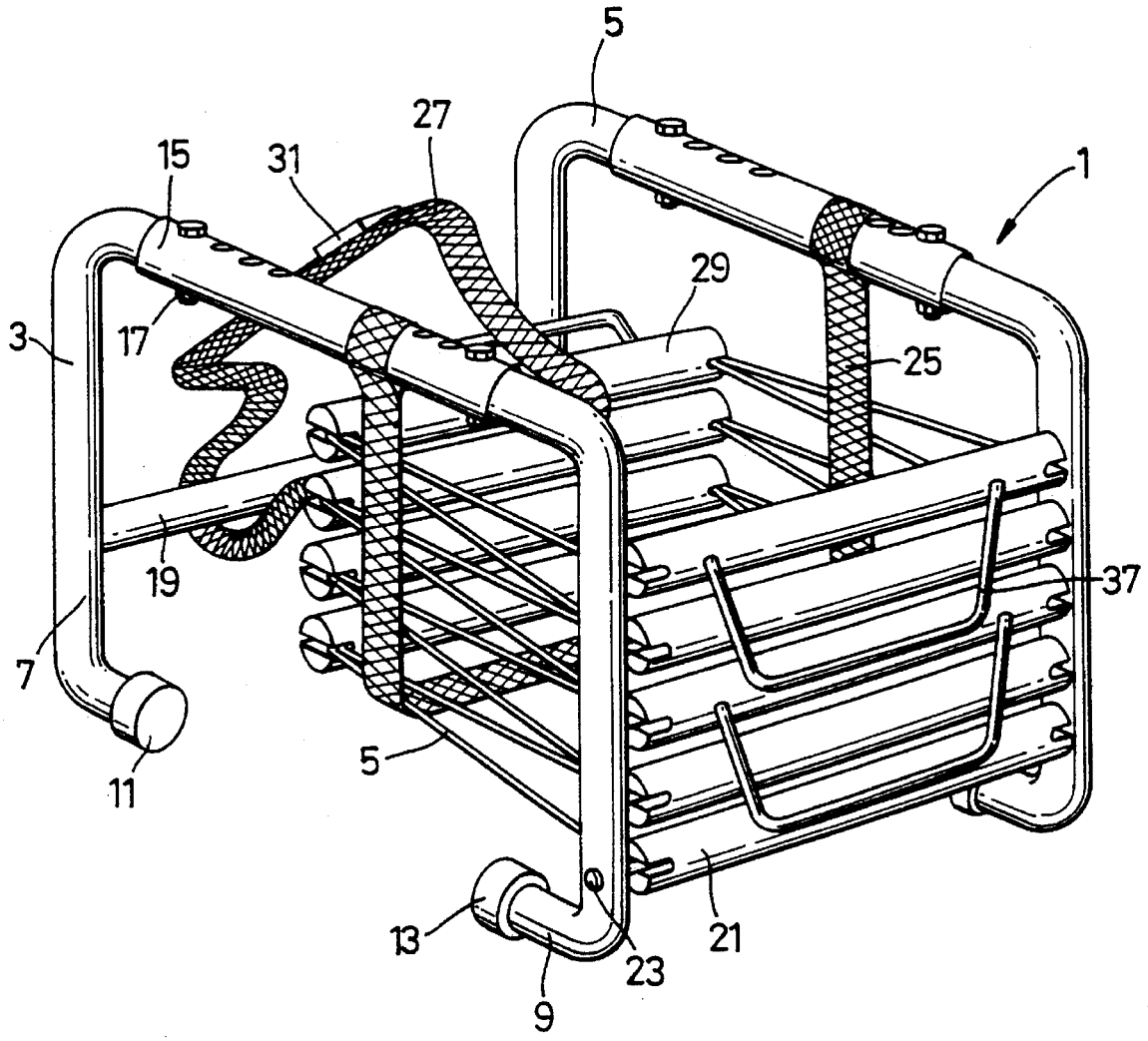

Bracket 3, which is shown in FIG. 1 in the orientation in which it would normally be stored, includes two side frames 5 each of which is provided with two substantially similar arms 7 and 9, each having respective free ends 11 and 13 provided with enlarged structure-engaging heads or caps formed of a hard rubber or other suitable material. The other ends of the arms 7 and 9 extend into a sleeve 15 to which they are attached by means of fixing elements 17. As can be seen in, for instance FIG. 1, sleeve 15 is provided with a series of spaced apart holes allowing each arm, 7 and 9, to be fixed rigidly to the sleeve in any one of a plurality of positions. Normally the pairs of arms in each side frame would be attached to sleeves 15 at aligned positions so that each side frame is of the same width (as measured between the bights of the arms), the width depending on the width of the structure about which the escape ladder is to be fixed.

The two side frames are interconnected by means of a single fixed link 19 extending between corresponding arms of the side frames. The side frames are further interconnected by means of one end rung 21 of the ladder by means of fixing pins 23 which allow for axial rotation of rung 21 relative to bracket 3.

As illustrated in FIG. 1, ladder 5 is, in its collapsed position, located within frame 3 and suspended on a flexible belt 25 extending between sleeves 15 of the frame. A further flexible belt 27 is in the form of a loop extending loosely around link 19 and a rung 29 of the ladder which is adjacent to the end rung remote from rung 21 attached to frame 3. Belt 27 has ends which in FIG. 1 are secured together at buckle 31.

Figure 2:
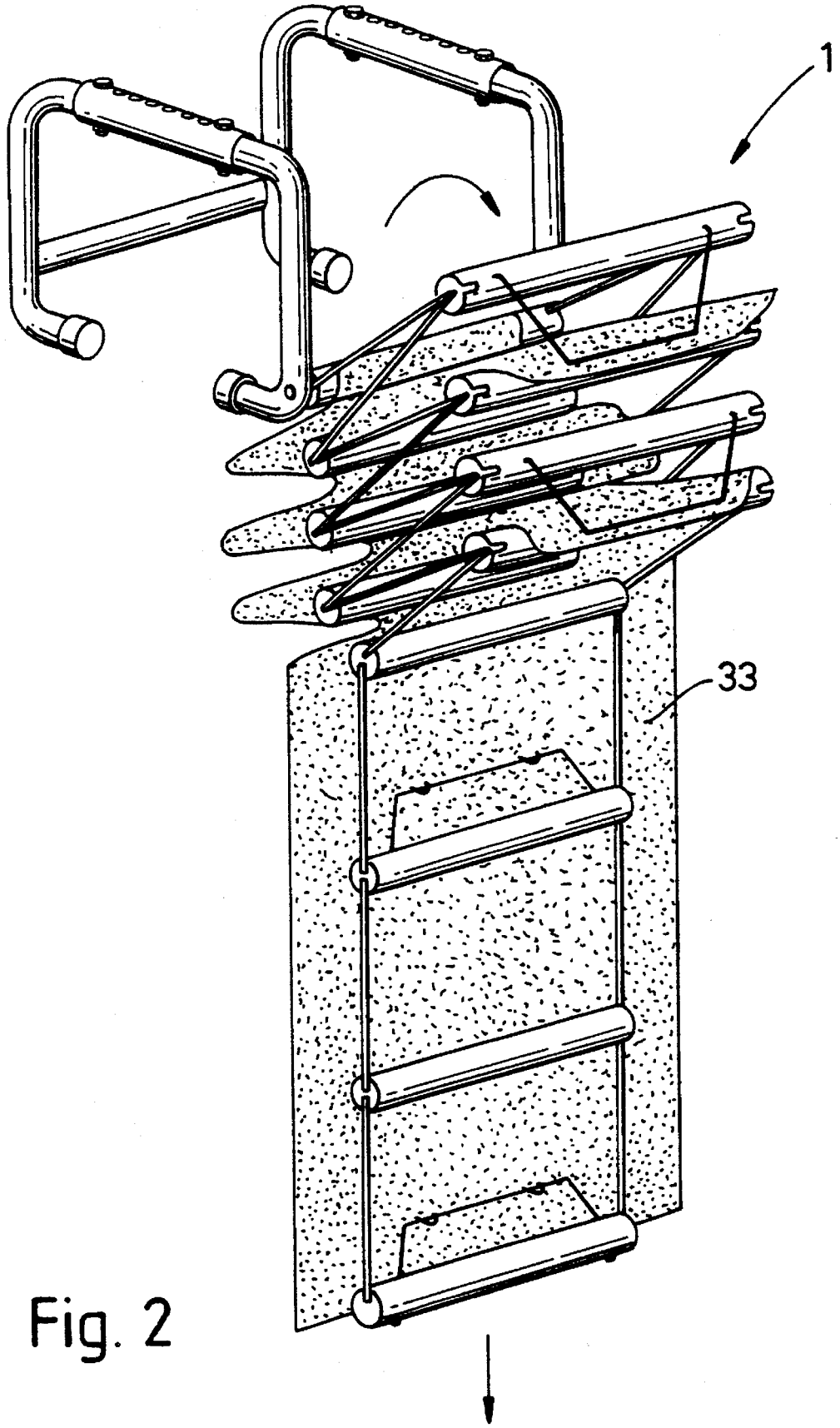
FIG. 2 shows the escape ladder of FIG. 1 in the course of being extended.
Figure 4:
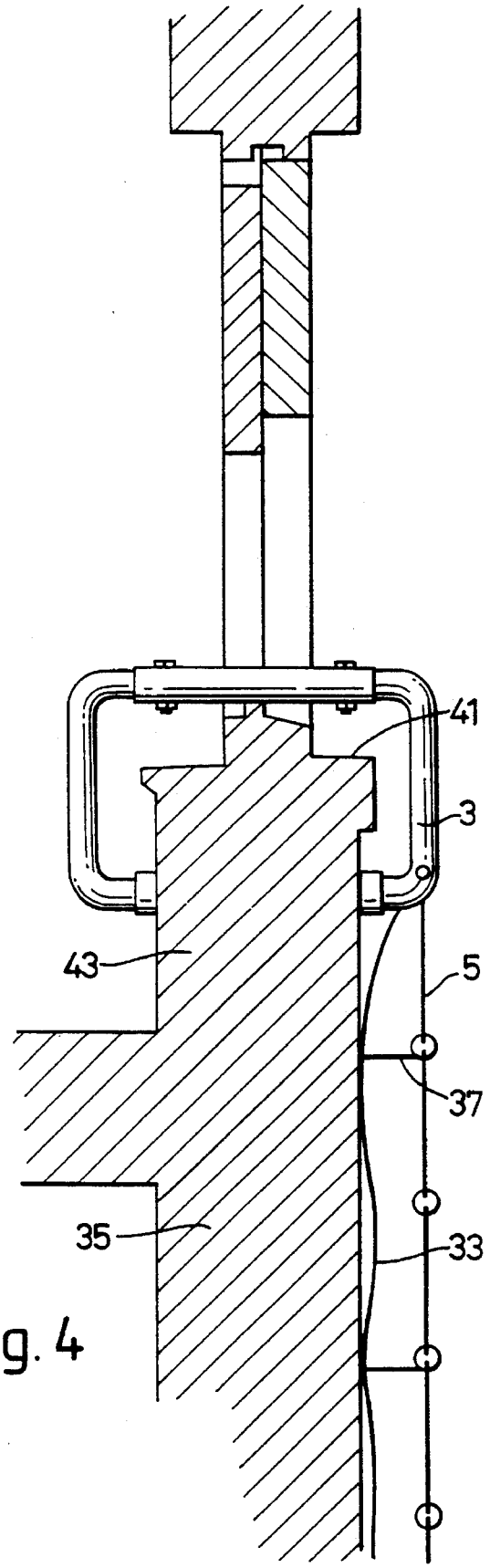
FIG. 4 shows the escape ladder of FIG. 1 fixed to a structure and in its fully extended condition.

Although not shown for the sake of clarity in FIG. 1, escape ladder 1 is provided with an elongate sheet of fire-proof material 33 which, when the ladder is in its folded condition, is sandwiched between the rungs, as indicated in FIG. 2. The arrangement is such that when the ladder is extended, as indicated in FIG. 4, the sheet fire-proof material 33 is sandwich between the ladder and the structure 35 to which the ladder is attached.

Attached to certain rungs of the ladder are stand-off elements 37, each being in the form of a substantially U-shaped rod, the ends of which are located in apertures in the rung. The function of stand-off elements 37 is best seen in FIG. 4. These elements act to space the ladder from the wall structure 35, thereby making it easier for the user of the ladder to place his feet securely on the rungs.

Figure 3:
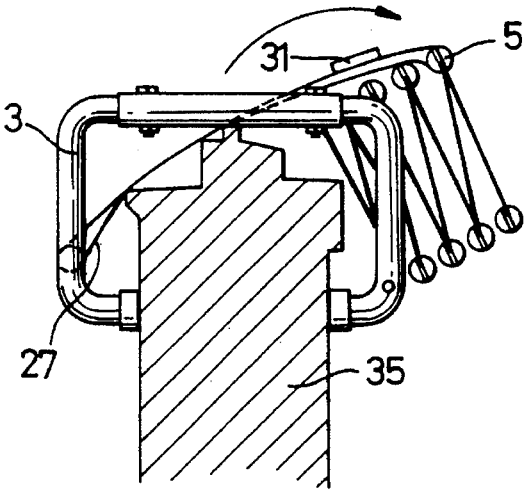
FIG. 3 shows the escape ladder of FIG. 1 fixed to a structure and just prior to release of the ladder from its collapsed to its extended condition.

In use, the escape ladder is located as shown in FIG. 3 with bracket 3 positioned over a window sill 41 forming pare of the window structure formed in wall 43. As indicated in FIG. 3 the ladder 5 is moved to a position where it is suspended over the front of the wall but is still held by belt 27. The button on buckle 31 of belt 27 is then operated to open the loop of the belt thereby releasing ladder 5. FIG. 4 shows the ladder in its fully extended position, hanging down from wall bracket 3, spaced by stand-off elements 37 from wall 43 and with the fire-proof sheet 33 lying between the ladder and the wall. Sheet 33 provides protection to the user of the ladder, particularly where the ladder passes across lower positioned windows where otherwise fire and smoke might cause problems for the user.

Figure 5:
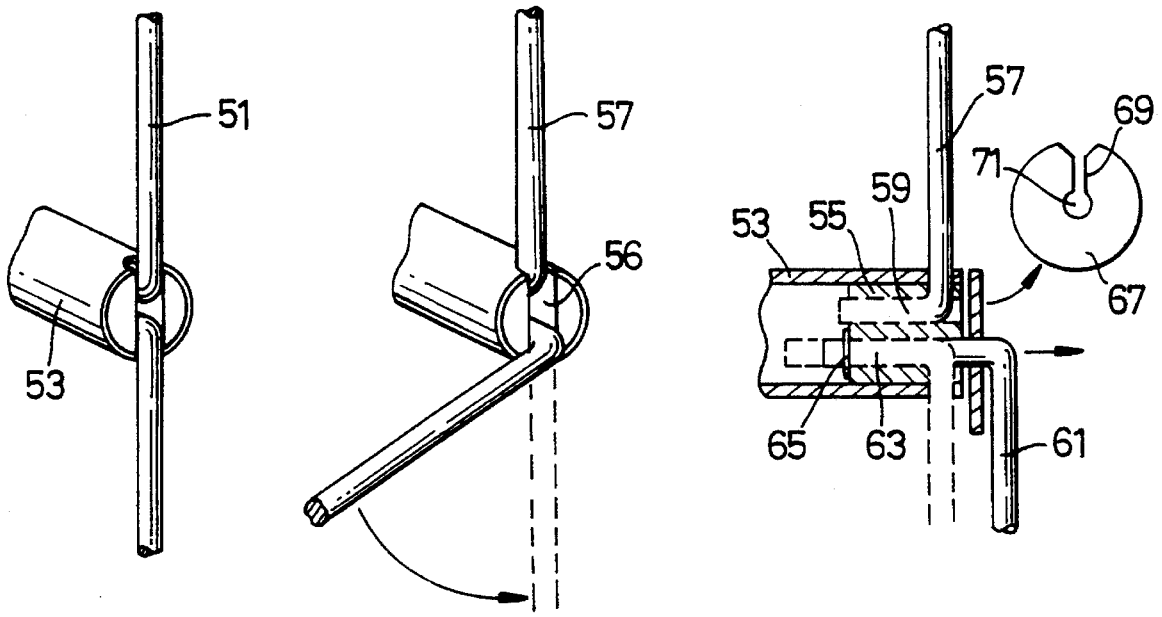
FIG. 5 illustrates in detail the locking system of the escape ladder of FIG. 1.

FIG. 5 shows in detail the interconnection of the side links 51 and the rungs 53 of the ladder. Each rung 53 is in the form of a hollow tube having at each end a plug 55. Plug 55 is provided with a diametric slot 86 which is orientated substantially vertically when the ladder is in use in its extended position. The hollow tube of rung 53 is provided with end cut-outs which are aligned with slot 56. Each side link 51 has a central portion 57 extending between two adjacent rungs. Each side link 51 is provided at one end with an end portion 59 which is bent over at right angles to the central portion 57 and is rigidly fixed into plug 55, thereby allowing no relative movement between this link 51 and rung 53.

Each link 51 has its other end bent over at tight angles to the central portion 57. This is illustrated in FIG. 5 in the right hand drawing of this figure where there is shown the other 61 of the two links 51 which engage the illustrated end of rung 53. In this case, however, the bent over end portion 63 of link 61 is mounted for axial movement within plug 55. The positions of the limits of the axial of the movement are both illustrated in the right hand diagram of FIG. 5.

Link 61 is prevented from moving outwardly, with respect to the end of rung 53 beyond the position shown in solid lines in the right hand diagram of FIG. 5 by means of ring 65, attached to and portion 63 near the end thereof. Ring abuts against the edge of plug 55. In this position link is free to pivot about the end of rung 53 as shown in the middle diagram of FIG. 5. End portions 63 of link 61 and plug 55 are provided with biasing means in the form of a spring (not shown) which urges the link end in a direction further into rung 53. When the link is moved into the position shown in dotted lines in the middle diagram of FIG. 5 it is urged by the spring into the position shown in dotted lines on the right hand diagram of FIG. 5. As a result the link is locked in the vertical position by means of the engagement of the upper end of the central portion of the link within the slot 56. In this way the ladder may adopt a rigid or semi-rigid condition when it is extended as shown in FIG. 4.

The right hand diagram of FIG. 5 illustrates how the link 61 can be prevented from adopting a locked position relative to rung 53. The ladder assembly is provided with discs 67 each of which is provided with a radial slot 69 extending from its circumference to an enlarged central cut out 71. Discs 67 may be pushed over the outer end of bent over portion 63 of link 61 to space the central portion of link 61 from the end of the rung and thereby prevent these elements being locked together.

By positioning discs 67 where appropriate the ladder can be made non-rigid where it extends over a corner, for instance, in a case where the ladder runs over an angled roof and then over the roof edge and then downwardly against a vertical wall.

In another embodiment a spring tension can be achieved in link 61 means of a link which is bent in such as way to provide spring tension within the link itself.

Figure 1A:
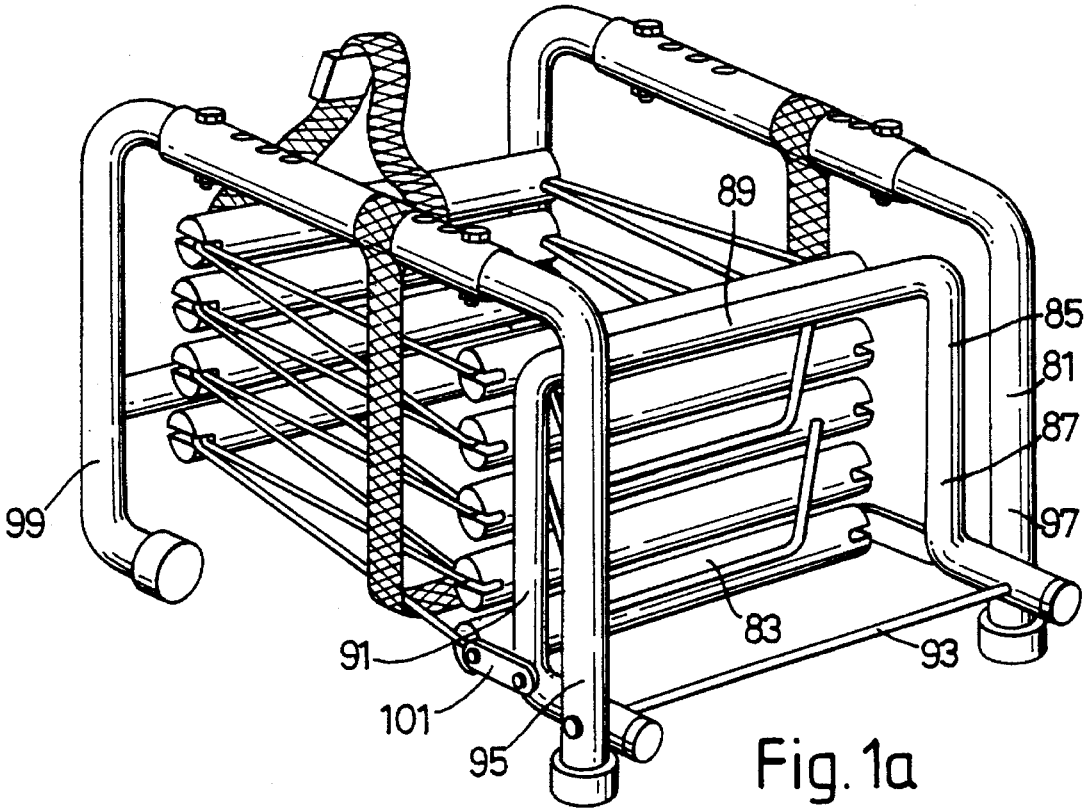
Figure 1B:
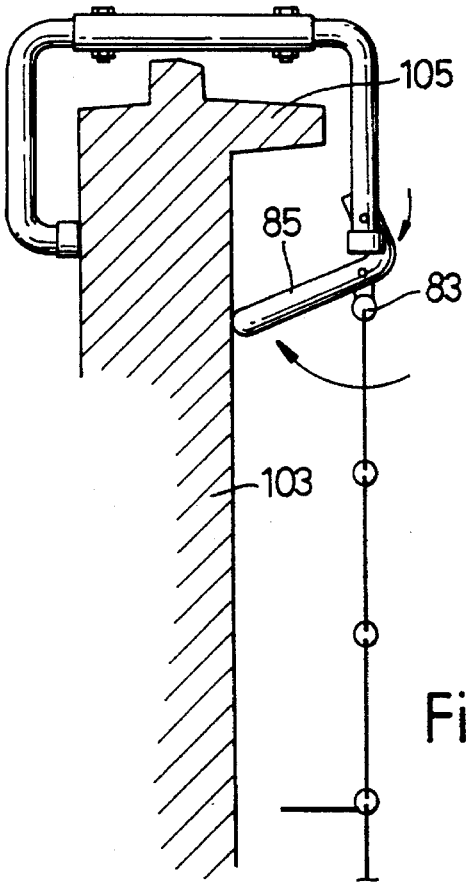

Referring now to FIGS. 1*a* and 1*b* of the accompanying drawings, a further embodiment according to the present invention is similar to that described above and is particularly useful in the case where there are large overhanging window sills on the outside of the building as indicated in FIG. 1*b*. In this case there is provided between the frame 81 and end rung 83 a structure engaging member 85. This member 85 includes a main body 87 having a central portion 89 with L-shaped arms 91 extending integrally from each end thereof. Extending between arms 91, near the free ends thereof, is a relatively thin rod 93 which runs through the end of main body 87 and locates in respective arms 95 and 97 of the frame 99 of the ladder assembly.

At the corners of L-shaped portions 91 of member 85, member is attached by links 101 to end link 83 of the ladder.

The nature of attachment of member 85 to both frame 99 and end link 83 allows relative pivotal movement between all three sections of the ladder. As a result, when the ladder is moved from the position shown in FIG. 1*a* to that shown in FIG. 1*b*, member 85 swings into the position shown in FIG. 1*b* where central portion 89 of this member engages the wall 103. It can be seen from FIG. 1*b* that member 85 enables the ladder assembly to be properly positioned and orientated over a structure with a window sill 105 of considerable outward extension.

I claim:

1. An escape ladder of collapsible construction, comprising:

a plurality of units attached to one another for forming a chain, each unit of said plurality of units comprising a rung and a pair of resilient side links, said side links extending from the rung and pivotally engaging opposite ends of the rung of an adjacent unit, wherein the rung of said adjacent unit is provided with detent means into which the side links are biassed, in a direction substantially parallel to an axis of the rung, at a predetermined relative orientation of said plurality of units for securing said units against relative rotation; and, a terminal unit including means for fixing the escape ladder to a structure.

2. The escape ladder according to claim 1, wherein the predetermined orientation of the plurality of units is achieved when they are substantially parallel.

3. The escape ladder according to claim 1, wherein an end portion of each of said side links remote from its respective rung is bent over and lies parallel to said rung.

4. The escape ladder according to claim 3, wherein each of said bent over portions is received within an aperture in an end of the rung of the adjacent unit.

5. The escape ladder according to claim 4, wherein said detent means comprises a slot in each of the ends of the rungs for receiving a portion of a length of a respective side link.

6. The escape ladder according to claim 1, further comprising means for preventing selected side links from entering their respective detent means.

7. The escape ladder according to claim 6, wherein said means for preventing selected side links from entering their respective detent means includes a plurality of removable covers for the detent means.

8. The escape ladder according to claim 7, wherein the end portion of each side link remote from its respective rung is bent over and lies parallel to the rung and the removable covers comprise discs adapted for being inserted around the bent over portion of a selected side link for shielding the respective detent means from the side link.

9. The escape ladder according to claim 1, wherein said means for fixing the escape ladder to a structure includes an adjustable claw bracket.

* * * * *